US005876056A

United States Patent [19]

Karlsen

[11] Patent Number: 5,876,056

[45] Date of Patent: Mar. 2, 1999

[54] ALPINE PAIR SKI

[75] Inventor: Jørgen Karlsen, Høvik, Norway

[73] Assignee: Hi-Turn AS, Raufoss, Norway

[21] Appl. No.: 693,151

[22] PCT Filed: Feb. 13, 1995

[86] PCT No.: PCT/NO95/00030

§ 371 Date: Aug. 6, 1997

§ 102(e) Date: Aug. 6, 1997

[87] PCT Pub. No.: WO95/21662

PCT Pub. Date: Aug. 17, 1995

[30] Foreign Application Priority Data

Feb. 11, 1994 [NO] Norway ..... 940482

[51] Int. Cl.[6] ..... A63C 5/04

[52] U.S. Cl. ..... 280/609; 280/608

[58] Field of Search ..... 280/608, 609, 280/14.2, 602, 601, 607, 11.18

[56] References Cited

U.S. PATENT DOCUMENTS

| | | | |
|---|---|---|---|
| 2,510,794 | 5/1950 | Beerli . | |
| 4,700,967 | 10/1987 | Meatto et al. | 280/609 |
| 4,795,184 | 1/1989 | Diard et al. | 280/609 |
| 4,971,349 | 11/1990 | Diard et al. . | |
| 4,971,350 | 11/1990 | Fagot | 280/609 |
| 5,018,760 | 5/1991 | Remondet . | |
| 5,242,187 | 9/1993 | Diard et al. . | |
| 5,286,051 | 2/1994 | Scherübl . | |
| 5,303,949 | 4/1994 | Harper et al. . | |
| 5,511,815 | 4/1996 | Karlsen . | |
| 5,727,807 | 3/1998 | Krafft et al. | 280/609 |

FOREIGN PATENT DOCUMENTS

| | | |
|---|---|---|
| 144 066 | 12/1935 | Australia . |
| 0579865 | 1/1994 | European Pat. Off. . |
| 0570467 | 1/1995 | European Pat. Off. . |
| 2559673 | 8/1985 | France . |
| 0608185 | 7/1994 | France . |
| 435 061 | 10/1926 | Germany . |
| 1958349 | 5/1971 | Germany . |
| 2403944 | 1/1974 | Germany . |
| 29 24 023 | 12/1980 | Germany . |
| 3441058 | 5/1986 | Germany . |
| 36 00 862 | 7/1986 | Germany . |
| 172170 | 8/1993 | Norway . |
| 88 426 | 2/1937 | Sweden . |
| 351 882 | 3/1961 | Switzerland . |
| 662 744 | 10/1987 | Switzerland . |
| 668000 | 11/1988 | Switzerland . |
| WO 86/10167 | 11/1989 | WIPO . |

*Primary Examiner*—Peter M. Poon
*Assistant Examiner*—Pamela J. Lipka
*Attorney, Agent, or Firm*—Merchant, Gould, Smith, Edell, Welter & Schmidt

[57] ABSTRACT

An Alpine pair ski (1) comprises a flat first sliding surface (2) and lateral surfaces (6*a, b*) provided with an approximately continuous concave sidecut between a first transition line A–A' defining the transition from a main section to a front section (3) and a second transition line E–E' defining the transition from the main section to a rear section (5), the course of a lower lateral edge (7*a, b*) between the transition lines A–A' and E–E' approximating a continuous curve. The sole on both sides of first sliding surface (2) comprises additional sliding surfaces (4) which extend upwards from the edge of the first sliding surface (2) to the lower lateral edges (7*a, b*) of the ski with an uplift ($H_s$) whose value at a point on the lower lateral edge (7*a, b*) of the ski is given by the length of the perpendicular from this point to plane of the sole. The additional sliding surfaces (4) extend in the longitudinal direction of the ski at least from the first and second transition lines A–A' and E–E' respectively towards a transversal line C–C' behind the middle of the ski and in that section of the ski where the binding is attached, the width of the ski at the line C–C' being equal to the smallest width of the ski between line A–A' and E–E'. The uplift ($H_s$) is in lower lateral edge (7*a, b*) on the additional sliding surfaces (4) substantially increases with the ski's increasing width in the direction of the lines A–A' and E–E' respectively.

12 Claims, 8 Drawing Sheets

1

1

ALPINE PAIR SKI

Figure 1:
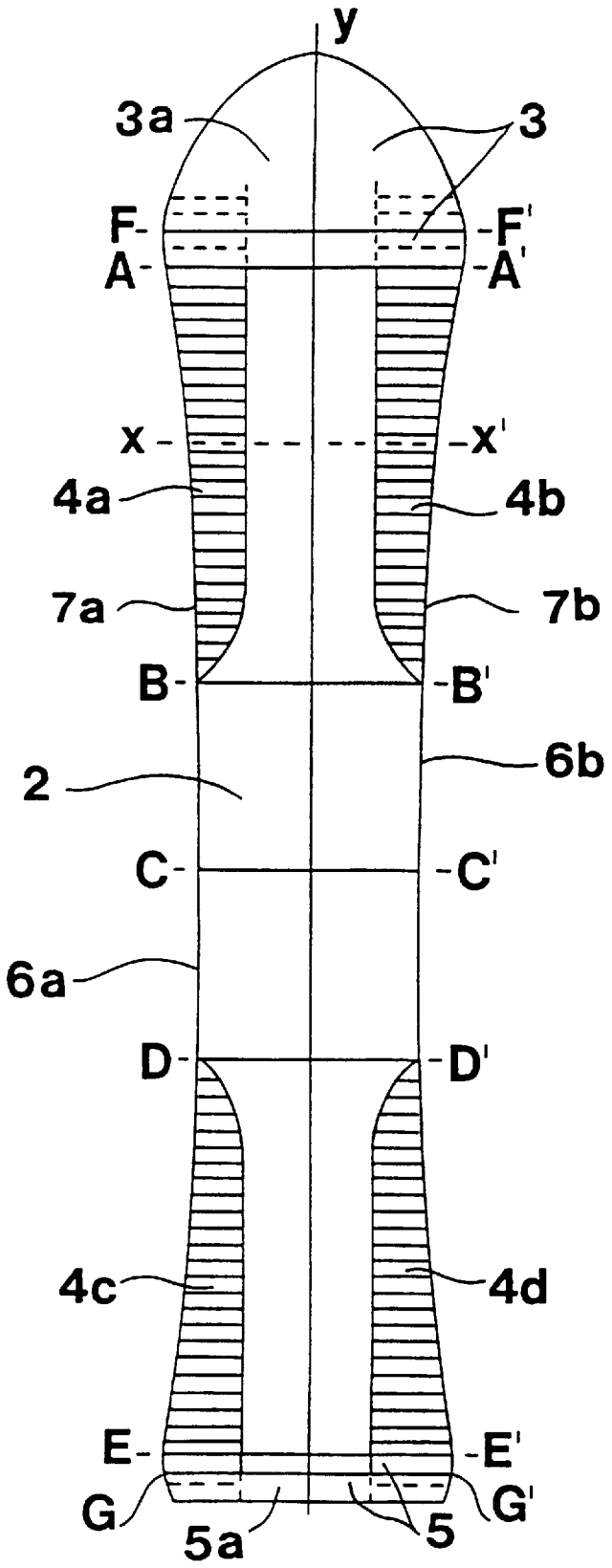

The invention concerns an Alpine pair ski with a front section including an upturned tip, a rear section including an end portion, and a main section with a sole which comprises, with reference to a plane of the sole with the ski's camber reduced to zero e.g. by applying a load to the ski, a flat first sliding surface which extends on both sides of the ski's central longitudinal axis Y at least to the front and rear sections respectively, and where the ski's lateral surfaces are provided with an approximately continuous concave sidecut between a first transition line A–A' defining the transition from the main section to the front section and a second transition line E–E' defining the transition from the main section to the rear section of the ski, the course of a lower lateral edge between the transition lines A–A' and E–E' approximating a continuous curve with a radius of curvature in any arbitrary point between the first and second transition line of 80 m or less.

In NO-PS 172 170 there is disclosed an Alpine pair ski which on a maximum 20 cm long front section of the main section has lateral surfaces whose lower edges diverge so greatly upwards in relation to the sliding surface and outwards sideways in relation to the ski's longitudinal axis that at the transition between the main section and the tip the ski has a width which is 15–70% greater than the width at the transition between this front section and the rest of the main section and where the lower edge of each lateral surface at the transition between the main section and the tip is located at a vertical distance above the plane of the sliding surface on the greater part of the main section, this vertical distance being at least 10% of the increase in width from the transition between the said front section and the main section to the transition between the main section and the tip.

The object of this known ski was to make it possible to turn with the least possible loss of kinetic energy, since the ski does not cut too deeply into the snow surface but nevertheless permits a good grip to be obtained when skidding.

Recent developments in the various branches of Alpine skiing, however, have involved not only an increase in speed, but also a considerable intensification of the demands on turning technique. In general the branches of Alpine skiing have become more extreme and this places increasing demands on the design of the skis. The above-mentioned known ski has an extreme outward curve in a front, 20 cm long section, this outward curve being out of proportion with the rest of the ski's outward curve. The extreme outward curve will make such a ski unstable during high speed and lead to problems with vibration. In addition the prior art ski will also lack a clean cutting edge, which means that the track which the front part of the ski carves in the snow will not be utilized by the rear sections of the ski.

The object of the present invention is therefore to provide a pair of Alpine skis which avoid the above-mentioned and other disadvantages and thus also make it possible to perform fairly tight turns at high speed without the ski edging or throwing up snow.

These objects are obtained according to the invention with a pair of Alpine skis which are characterized in that the the sole on both sides of the first sliding surface comprises additional sliding surfaces which extend upwards from the edge of the first sliding surface to the lower lateral edges of the ski with an uplift whose value at a point on the lower lateral edge of the ski is given by the length of the perpendicular from this point to said plane of the sole, the additional sliding surfaces extending in the longitudinal direction of the ski at least from the first and second transition lines A–A' and E–E' respectively towards a transversal line C–C', substantially perpendicular to the central longitudinal axis Y behind the middle of the ski and in that section of the ski where the binding is attached, the width of the ski at the line C–C' being equal to the smallest width of the ski between line A–A' and E–E', the additional sliding surfaces thus extending on each side over a length which is at least 20% of the length of the main section between the lines A–A' and E–E', and such that the length of the additional sliding surfaces in the main section from line A–A' toward line C–C' in any case is at least 20 cm, and that the uplift in a lower lateral edge on the additional sliding surfaces substantially increases with the ski's increasing width in the direction of the lines A–A' and E–E' respectively, with the result that in each case the uplift at A–A' is at least 1/2000 (one two thousandth) of the length of the first sliding surface between the lines A–A' and E–E'.

Further features and advantages of the pair of Alpine skis according to the invention are apparant from the appendent claims.

The invention will now be described in more detail in connection with embodiments and with reference to the attached drawing.

FIG. 1 is a schematic plan view of an Alpine pair ski according to the present invention.

Figure 2A:
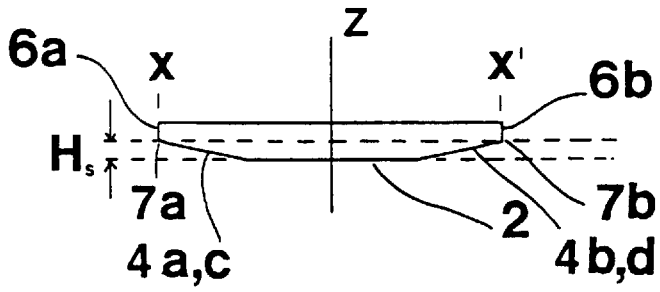
Figure 2B:
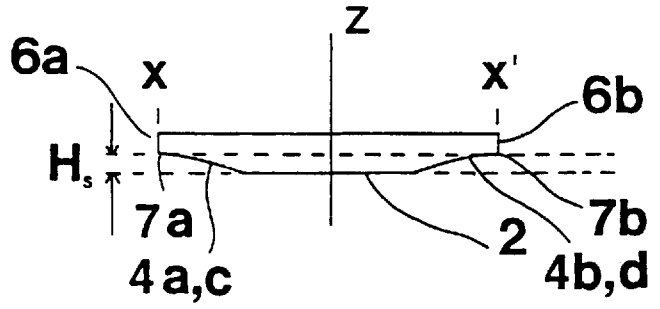
Figure 2C:
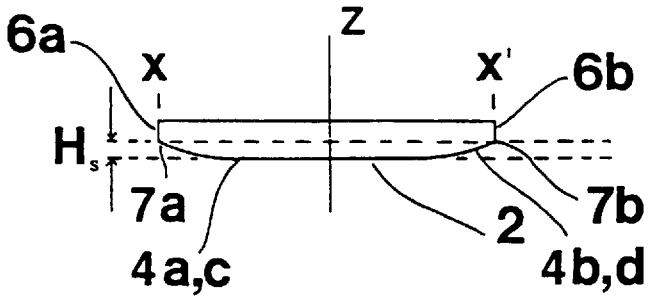

FIGS. 2*a–c* is a cross section of the ski in FIG. 1, viewed along line x–x'.

Figure 3:
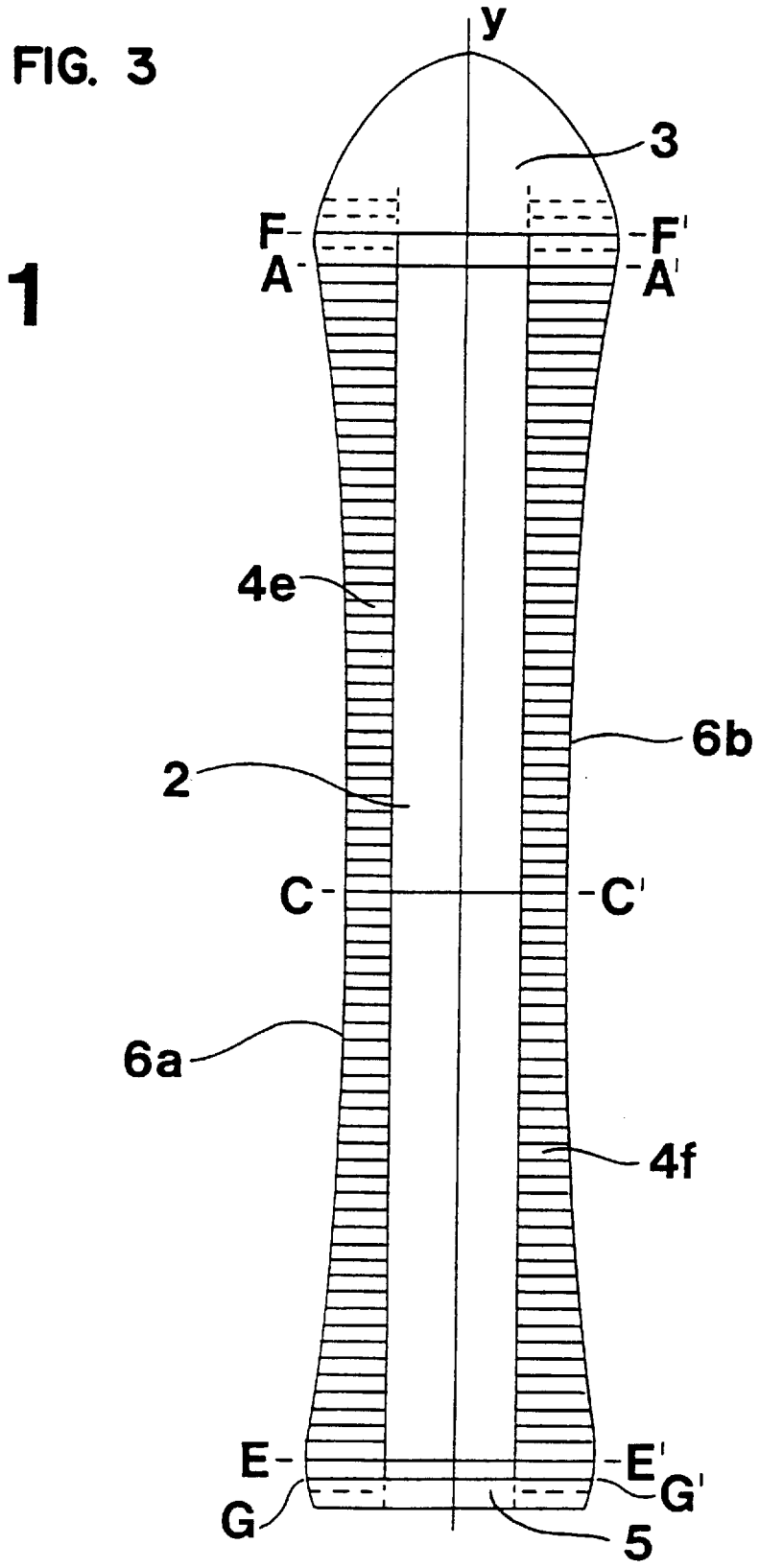
Figure 4:
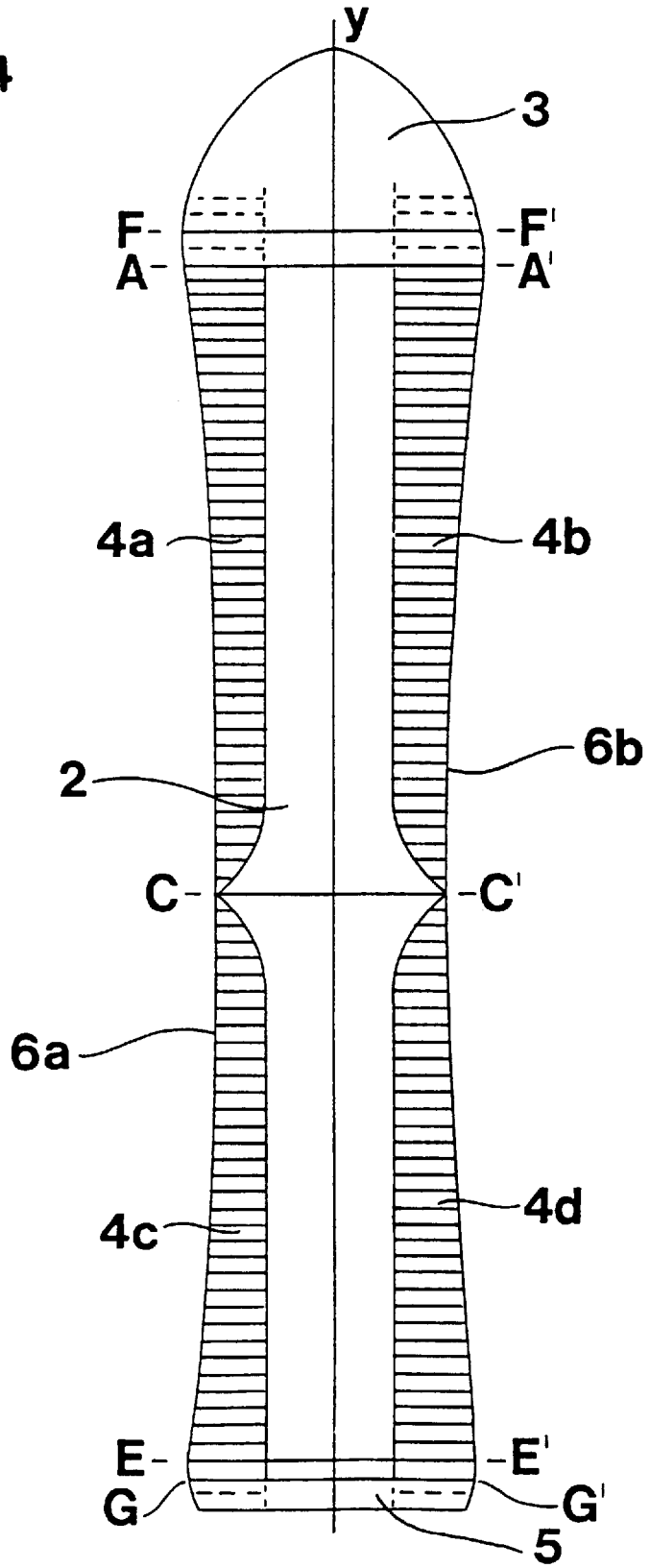

FIGS. 3 and 4 are a plan view of different designs of the sole of the ski according to the present invention.

Figures 5A, 5B, 5C:
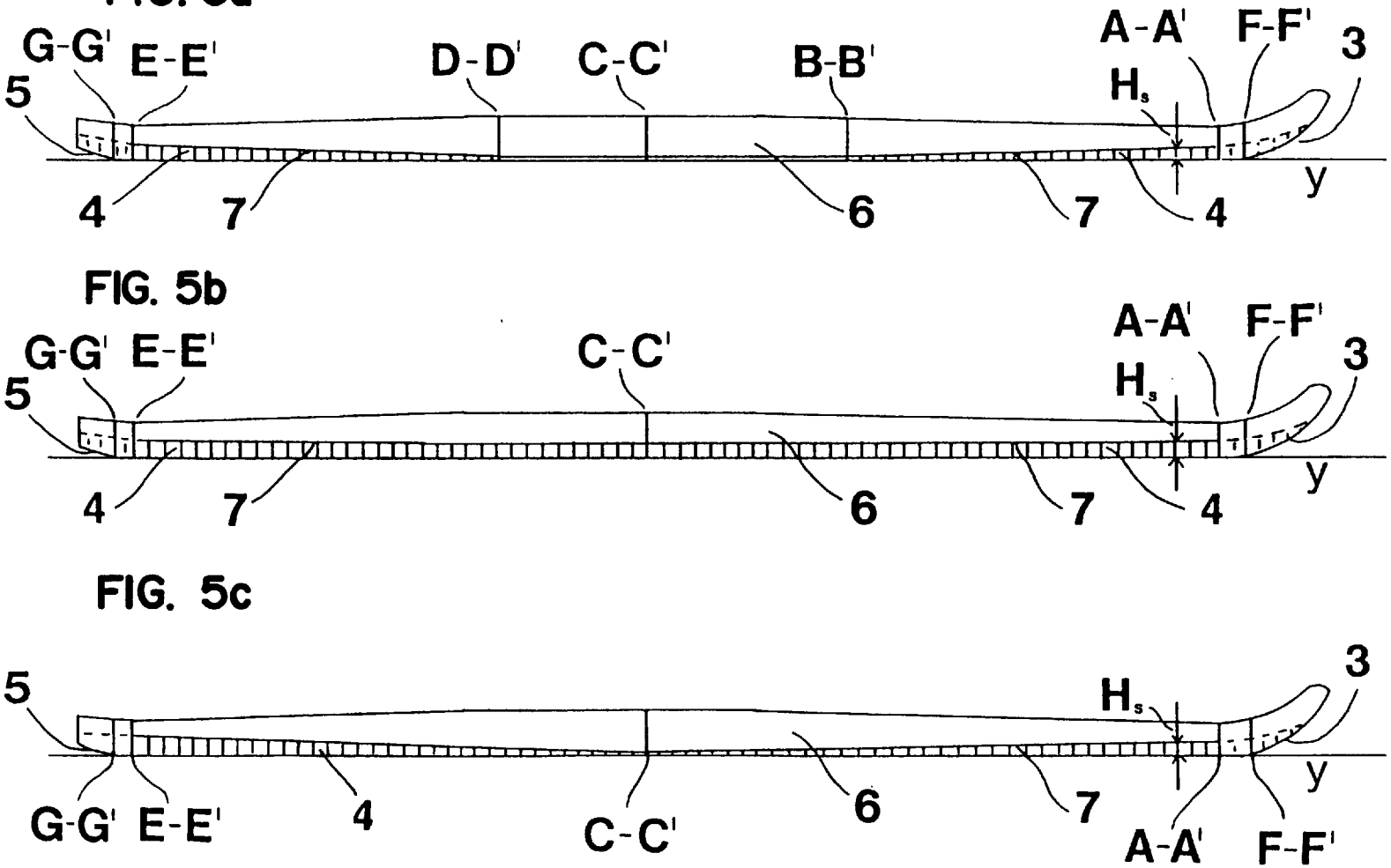

FIGS. 5*a–c* is a side elevation of the skis in FIGS. 1, 3 and 4.

Figure 6:
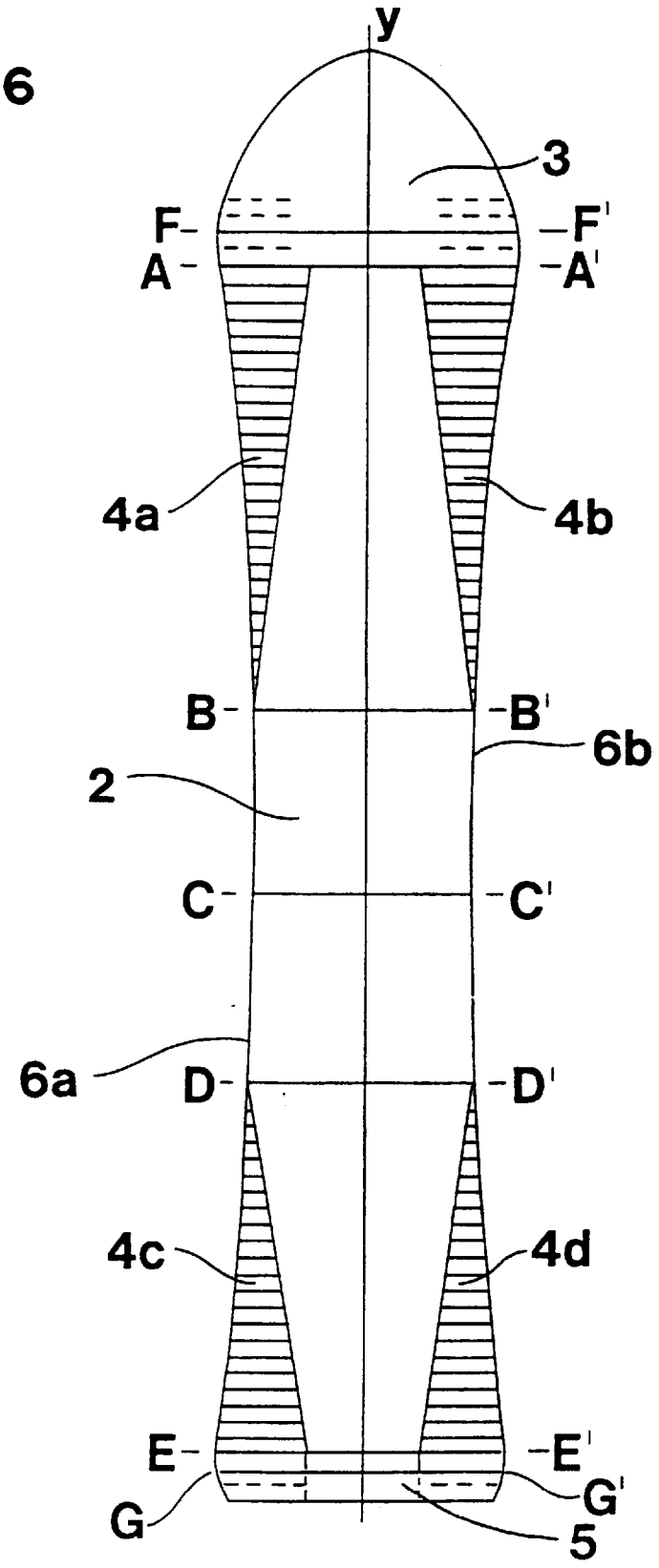
Figure 7:
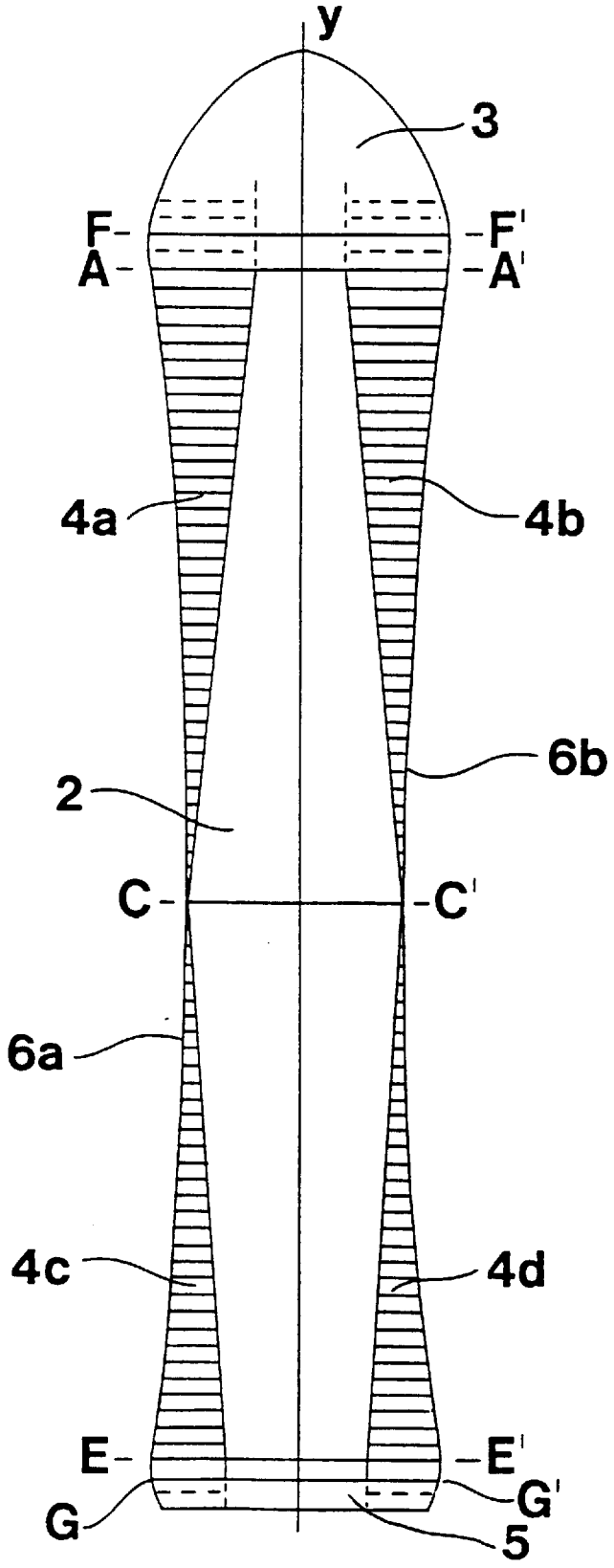
Figure 8:
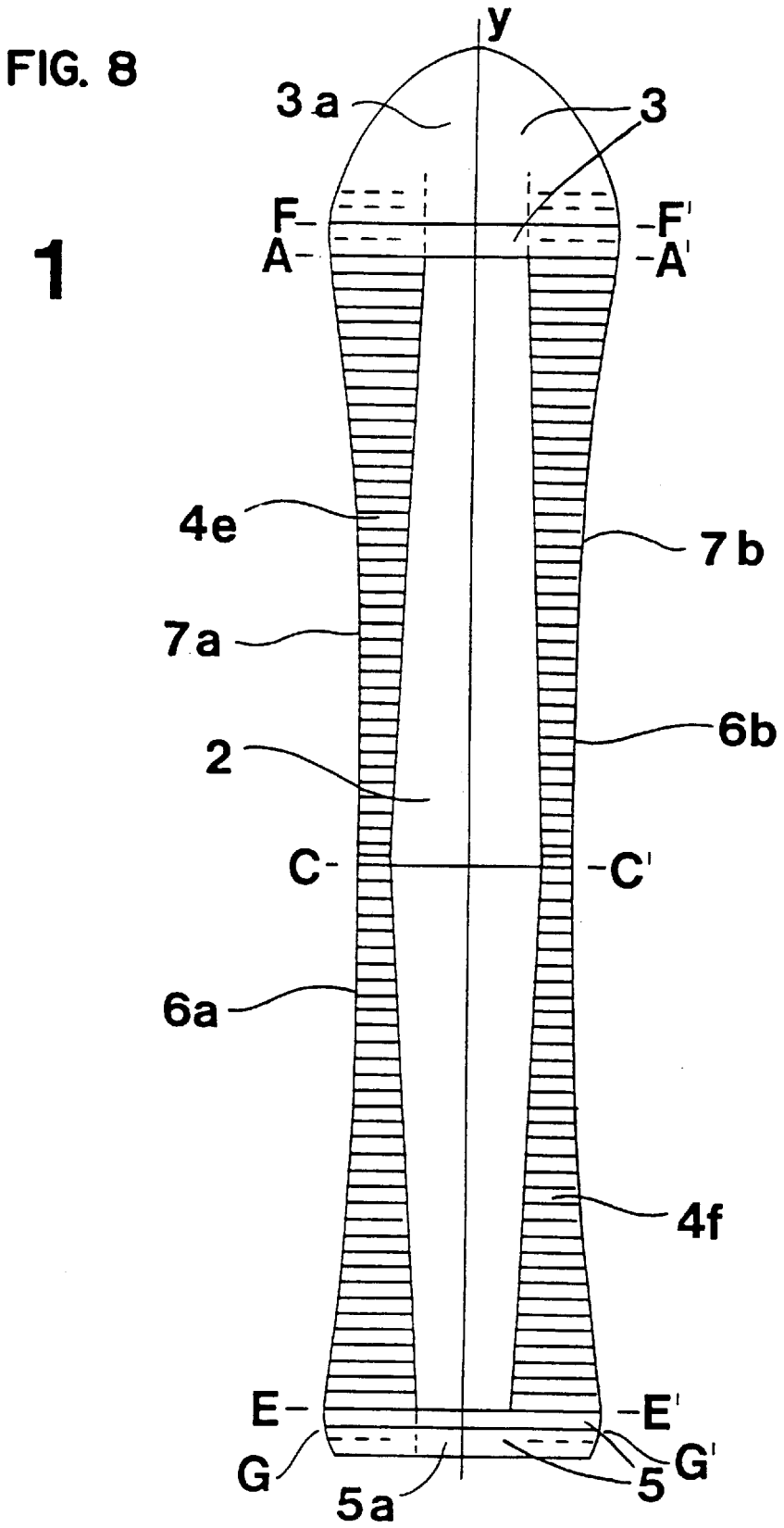

FIGS. 6–8 are a plan view of further designs of the sole of the ski according to the present invention.

The embodiments of the ski according to the invention and as shown in the figures are all of a symmetrical ski. However, the ski according to the invention could also be an asymmetric ski, of which more shall be said later. The following discussion is, however, limited to embodiments of a ski that is symmetrical around a central longitudinal axis and as shown in FIGS. 1–8.

FIG. 1 shows an Alpine pair ski 1 according to the present invention. The ski 1 has a main section with a sole which is located between the perpendicular transition lines A–A' and E–E' on a central longitudinal axis Y of the ski, line A–A' defining the transition to a front section 3 and line E–E' the transition to a short, slightly upturned rear section 5 of the ski 1. The sole in the main section of the ski between A–A' and E–E' comprises a first sliding surface 2. Usually all skis have a longitudinal camber, that is, the ski has an upward curvature when unloaded. When the design load, i.e. the weight of the skier is applied to the ski, the camber is reduced towards zero and the sole of the ski will be resting in a plane, which in the following description will be regarded as defined by the sliding surface 2. This sliding surface 2 extends substantially symmetrically about the ski's central longitudinal axis Y. On both sides of the sliding surface 2 there are provided additional sliding surfaces 4*a, b, c, d* which extend between the first sliding surface 2 and the lateral surfaces 6*a, b* of the ski which in the representation in FIG. 2 meet the sole in the lower lateral edges 7*a, b*, which is best illustrated in the section taken through x'x—' in FIG. 1 and illustrated in one of the FIGS. 2*a–c*. In FIG. 1 the first sliding surface 2 in the section between A–A' and a transverse line B–B' is limited by lateral edges substantially parallel to the central longitudinal axis Y and the section between E–E' and an additional transverse line D–D' has been given a corresponding form. In the section between B–B' and D–D' the first sliding surface 2 extends all the way until it meets the lateral surfaces 6*a*, 6*b* in the respective lower lateral edges 7*a* and 7*b*. The additional sliding surfaces 4*a–d* thus extend from the first sliding surface 1 towards the lower lateral edges 7*a* and 7*b* in those sections of the sole which are located between A–A' and B–B' respectively and between D–D' and E–E' respectively. The distance between A–A' and B–B' and D–D' and E–E' should together comprise at least 20% of the length of the ski between A–A' and E–E', and preferably 50% or more, depending on the desired functional performance of the ski.

As is known per se the lateral surface of the ski 1 between A–A' and E–E' is provided with a concave sidecut in the direction of the ski's central longitudinal axis Y, thus causing the section of the ski between A–A' and E–E' to be substantially indented. The transversal line C–C' which is located between A–A' and E–E' is situated approximately at the middle of the ski or slightly behind it, approximately where the binding is located. C–C' is perpendicular to the ski's central longitudinal axis Y and can represent a transversal axis X orthogonal to the central longitudinal axis Y, the X,Y plane thus simultaneously defining the plane of the first sliding surface. Over the width of the ski the transverse line C–C' has an extension which in any case equals the minimum width of the ski between A–A' and E–E'.

As shown in FIG. 1, the transition line A–A' as mentioned marks the transition to a front section 3 including the upturned tip 3*a* of the ski. The curve of the sidecut has a turning point at the line A–A'. The width of the ski however increases towards a transversal line F–F' marking the transition to the tip 3*a* and usually also defining the maximum width of the ski. Depending on the parameters chosen for the sidecut, distance between A–A' and F–F' may be very small, but usually lies between 2 and 5 cm.

Similarly the transition line E–E' as mentioned marks the transition to a rear section 5 with the curve of the sidecut having a turning point in E–E'. The transversal line G–G' marks the transition to a usually upturned end portion 5*a* of the ski.

The sidecut or outward curve of the ski's lateral surfaces 6*a* and 6*b* between A–A' and E–E' follows approximately the line of a continuous curve and can be approximately defined by congruent circular arcs or elliptic arcs on each side of the ski's central longitudinal axis Y. In the case of congruent circles C–C' forms an extension of the radius of the circle and the lower lateral edges 7*a*, 7*b* between the circular arcs A–A' and E–E' respectively. Similarly the transversal line C–C' can be the extension of the ellipse's minor axis and the lower lateral edges 7*a*, 7*b* the elliptic arcs which extend on each side of the point of intersection between C–C' and the lower lateral edges 7*a*, 7*b*.

It should be understood that the sidecut of the lateral surfaces 6*a* and 6*b* can deviate slightly from a perfect circular arc or elliptic arc and may, for example, be larger or smaller than this. In general, however, this deviation should not be greater than in the case where, by means of two points in one of the lower lateral edges 7*a*, 7*b*, a 20 cm long section is defined, as measured on the central longitudinal axis Y, in this lower lateral edge, a circle which is drawn through the end points of this section together with its midpoint should have a radius which does not exceed 80 metres. If the sidecut of the lateral surfaces 7*a* and 7*b* between A–A' and E–E' is defined by circular arcs as described above, the radius of the defining circle should not deviate by more than ±20% from the imaginary circle which can be drawn through the starting and end points together with the midpoint of the randomly selected section on one of the lower lateral edges 7*a* or 7*b*. Similarly it is the case that, when the sidecut of the lateral edges 6*a* and 6*b* is defined by elliptic arcs, the radii of curvature in the elliptic arc within a corresponding randomly selected section should not deviate by more than ±20% from the radius of the imaginary circle which passes through the starting and end points together with the midpoint of this section.

Thus the degree of sidecut between A–A' and E–E' can be modified in such a way that for instance the portion of the ski which is located closer to A–A' than B–B' deviates from the defining circular or elliptic arcs. In theory, the sidecut of the lateral surfaces 6*a* and 6*b* could also be produced by the lateral surfaces being composed of short, straight surfaces, with the result that the lower lateral edges 7*a* and 7*b* would appear as the sides of a polygon, but it will be obvious that these sides of the polygon of course will approximate the continuous curve which defines the sidecut of the lateral surfaces, whether this is a circular arc, an elliptic arc or another continuous curve.

Finally each of the lateral surfaces 6*a, b* could be defined by mutually deviating curved shapes, for example by an ellipse and a circle respectively. This would give the ski a slight asymmetry about the central longitudinal axis Y and is not shown in the figures, but will be discussed below.

The additional sliding surfaces 4*a–*4*d* which extend from the edge of the first sliding surface 2 towards the lower lateral edges 7*a* and 7*b* have been provided with an upward curve or an uplift $H_s$ from the edge of the first sliding surface 2 towards these lateral edges, as is best illustrated in one of the FIGS. 2*a–c*. Thus the lateral edges 7*a*, 7*b* will be located above the plane of the first sliding surface 2 at a distance which is indicated by $H_s$ in FIGS. 2*a–c* and further in FIGS. 5*a–c*. The additional sliding surfaces 4*a, b, c, d* thus extend from the first sliding surface 2 with an upward curve towards the lower lateral edges 7*a, b*, and the line of the additional sliding surfaces 4*a, b, c, d* can thus be a straight oblique line or chamfering as illustrated in FIG. 2*a*, but also in cross section form a concave section as illustrated in FIG. 2*b* or have a convex form towards the plane of the first sliding surface as illustrated in FIG. 2*c*.

It is preferred that the additional sliding surfaces should have a form as illustrated in FIG. 2*a*, since it is assumed that it is this form which gives the ski its best characteristics. It will also be possible to combine two or more forms. For example, a rectilinear form could develop into a concave section form near the lower lateral edge.

Moreover the uplift $H_s$ should be in proportion to the increase in width of the ski which is obtained from the sidecut of the lateral surfaces, thus causing the uplift $H_s$ in a lower lateral edge to increase with the width of the ski in the direction of A–A' and E–E' respectively. In other words, in FIG. 1 the uplift at B–B' is zero, increasing towards A–A' in such a manner that the uplift curve at A–A' in each case constitutes at least one two thousandth (1/2000) of the distance between A–A' and E–E'. At the edge of the first sliding surface 2, i.e. the line or curve which defines the transition between the first sliding surface 2 and the additional sliding surfaces 4*a, b, c, d* the uplift is of course zero, the additional sliding surfaces thus together having an upward curve in the direction of the lower lateral edges 7*a, b* while at the same time this upward curve increases in the direction of A–A' and E–E' respectively. Thus the additional sliding surfaces are raised above the plane of the first sliding surface to a degree which substantially increases with the increasing width of the ski.

The first sliding surface 2 as well as the additional sliding surfaces 4*a–*4*d* shall at least extend to the transition lines A–A' and E–E', but may optionally be extended into the front section 3 and the rear section 5, terminating at the lines F–F' and G–G', respectively, as indicated in e.g. FIGS. 2, 3 and 4. In this case the uplift of the lower lateral edges 7*a*,7*b* between A–A' and F–F' should be at least as large as the uplift in A–A'. Correspondingly the uplift $H_s$ of the lower lateral edges 7*a*, 7*b* between E–E' and G–G' should be at least as large as the uplift in E–E'.

In FIG. 1 the first sliding surface 2 extends to the lower lateral edge in the section between B–B' and D—D and here there is naturally no uplift. In other words the uplift of the additional sliding surfaces 4*a, b, c, d* is reduced to zero at D—D and B–B' respectively.

The uplift as defined at a random point on the lower lateral edge 7*a, b* can preferably be given as an approximate linear function of the increase in the width of the ski between C–C' and a perpendicular in the plane of the ski or its sole the central longitudinal axis Y at this point, the uplift being represented by the following formula $$H_s=K_1+K_2\Delta X+M(y)$$

Here $H_s$ is the upward curve in mm, $K_1$ and $K_2$ appropriate selected constants, ΔX the increase in width and M(y) a function of the distance, i.e. the length of the ski between C–C' and the said perpendicular, since the functional value |M(y)| should be less than 1 mm.

In calculating the ski the coordinate axes can preferably be located in such a manner that the Y axis is as illustrated in FIG. 1 and C–C' constitutes the orthogonal X-axis, the X,Y plane defining the plane of the first sliding surface. As a basis for the calculation of the increase in width, i.e. the sidecut of the lower lateral surfaces 6*a* and 6*b*, congruent circular arcs or elliptic arcs can be used as described and the increase in width can then easily be calculated as a value ΔX for a corresponding increase ΔY in the length of the ski.

As a supplement to the description, in tables 1–5 numerical examples are given of the calculation of a symmetrical Alpine pair ski according to the present invention, on the basis of selected parameters for the width of the ski at C–C' and the length of the ski between C–C' and A–A' and C–C' and E–E' respectively. The sidecut of the lateral surfaces has been defined by selecting the radius of a circle or the major and minor axes of an ellipse respectively.

FIG. 3 illustrates a second embodiment of the ski 1, where the sliding surface 2 is distinguished from that in FIG. 1 by being limited by straight lines between A–A' and E–E' parallel to the ski's central longitudinal axis Y. The additional sliding surfaces 4*e, f* thus extend between the lower lateral surfaces 6*a, b* and the first sliding surface 2 on both sides of this and along the entire length of the ski between A–A' and E–E' or between F–F' and G–G' if preferred, the lower lateral edges 7*a, b* over the entire distance between A–A' and E–E' thus obtaining an uplift. Here too the uplift increases with the increasing width of the ski in the direction of A–A' and E–E', the uplift in each case thus having a minimum value in the lateral edges at C—C. At the same time the uplift in C–C' should not be too great since otherwise the ski may acquire an unsatisfactory edge grip in the middle, and it should have a maximum of 2 mm and preferably not more than 1 mm.

In FIG. 4 the lower sliding surface is still limited by straight, parallel lines, but preferably in the vicinity of C–C' the first sliding surface 2 is moved right out to the lower lateral edge and touches it at the point of intersection between C–C' and the lower lateral edges 7*a*, 7*b*. In this case the uplift is zero or practically zero at C–C', but increases again from C–C' towards A–A' and E–E' in relation to the increasing width, i.e. the outward curve of the lateral edges towards A–A' and E–E'.

FIGS. 5*a*–5*c* is a side elevation of the skis in FIGS. 1, 3 and 4 respectively. The degree of the uplift $H_s$ in the longitudinal direction is illustrated and indicated by the line of the lower lateral edge 7 in the lateral surface 6 of the ski. In FIG. 5*a* there is no uplift in that section of the ski which is located between B–B' and D–D', while in FIG. 5*b* it can be seen that the lateral edge has an uplift $H_s$ which reaches a minimum at C–C', whereupon it increases in the direction of A–A' and E–E' respectively. Finally FIG. 5*c* shows that the uplift $H_s$ decreases from A–A' and E–E' respectively towards C–C' until it becomes zero at the point where C–C' meets the lower lateral edge 7.

Other examples of possible designs of the sole with the first sliding surface 2 and the additional sliding surfaces 4 are illustrated in FIG. 6, where the first sliding surface 2 between A–A' and B–B' and also between D–D' and E–E' is limited by lines which cause the sliding surface 2 to converge from the lower lateral edges 7*a, b* in B–B' and D–D' respectively and towards A–A' and E–E' respectively. Thus in the section between B–B' and D–D', in this case the first sliding surface extends to the lower lateral edge 7*a, b* of the ski and consequently the uplift of the lower lateral edge between B–B' and D–D' is zero.

In FIG. 7 the first sliding surface 2 converges towards A–A' and E–E' respectively and just touches the lower lateral edges 7*a* and 7*b* at the point of intersection between C–C' and the lower lateral edges 4A, 4B, the uplift at C–C' thus becoming zero and otherwise increases gradually from C–C' towards A–A' and E–E' respectively.

FIG. 8 illustrates an embodiment of the ski according to the invention in which the first sliding surface 2 is provided with a contour which is closer to the embodiment shown in FIG. 4, but differs from this in that the edges of the first sliding surface 2 are not parallel lines, but converge from C–C' in the direction of A–A' and E–E' respectively. Thus the first sliding surface 2 has a maximum width at C–C', but this maximum width is less than the width of the ski at C–C' and consequently the additional sliding surfaces 4*e,f* extend on each side of the first sliding surface 2 over the entire length of the ski between A–A' and E–E', the lower lateral edge in C–C' thus having an uplift which is not zero and from C–C' increases with the increase in width in the direction of A–A' and E–E' respectively.

It will be obvious to a person skilled in the art that further designs of the form of the sliding surfaces are possible within the scope of the invention and they need not be limited to those designs illustrated in the figures. However, experience shows that for an Alpine pair ski with good turning characteristics and which are easy for even a skier with little experience to maneuver, the embodiment illustrated in FIG. 4, in which the first sliding surface 2 is partially limited by straight parallel lines and extends to the lower lateral edge at C–C', appears to be particularly appropriate. However, it should be noted that the embodiments in FIGS. 1 and 4 are practically similar, so the uplift $H_s$ in C–C' and its vicinity is at a minimum.

As mentioned above the ski according to the invention may be asymmetrical about the central longitudinal axis Y. The asymmetry may be obtained in different ways. For instance the sidecut of each of the lower edges may be dissimilar, such that the radius of curvature between the transition lines A–A' and E–E' in an arbitrary point on a lower lateral edge 7*a*, 7*b* is different from the radius of the curvature in a corresponding arbitrary point on the other lower lateral edge 7*a*; 7*b* when the arbitrary points are lying on a line orthogonal to the central longitudinal axis Y of the ski. If the sidecut of the lateral surfaces 6*a*, 6*b* is similar, the asymmetry may be provided by moving the lateral surfaces in mutually opposite directions towards the front and the rear of the ski, respectively. In any case, the resulting transition lines A–A', E–E' will be non-perpendicular to the ski's central axis Y, and also possibly mutual non-parallel lines. The merits of an asymmetrical ski is, however, a matter of discussion among persons skilled in the art. An asymmetrical ski may, however, offer some advantage when it is considered that the turning radius of the inner edge of the leading ski in a turn will be less than the turning radius of the outer edge. The table 6 gives a numerical example of calculation of an asymmetrical Alpine pair ski according to the present invention on the basis of selected parameters for the length of the ski between C–C' and A–A' and C–C' and E–E', respectively.

The Alpine pair ski according to the present invention offers a number of advantages over known skis of a similar type. As already mentioned, the sidecut of the lateral surfaces, i.e. the outward curve, permits the ski to make very sharp turns without throwing up snow. If the preferred sidecut of the lateral surfaces follows the curvature in a circular arc or elliptic arc, it will be possible to deviate from this arc form in order to compensate for dynamic conditions which arise when the ski is in use, i.e. primarily torsional forces and bending forces. In practice this indicates that the sidecut of the lateral surfaces should increase slightly more than the radius of curvature of the arc indicates, the closer one comes to A–A'. This will give the ski a clean cutting edge and will mean that the track carved by the ski's front section can also be used by the ski's rear section.

If a ski is completely rigid, even a fairly small sidecut of the lateral surfaces 6*a*, 6*b*, i.e. a small outward curve, will result in the ski losing contact with the snow surface in the midsection when it is edged in order to turn. The greater the sidecut and outward curve, the more flexible a ski with a flat sole must be in order to obtain a good edge grip on the midsection of the ski. If the outward curve is too great, a flat ski requires such a low degree of flexural rigidity that it is of no practical use. With the ski according to the present invention the use of an uplift in the lower lateral edges will permit a combination of a high degree of sidecut, i.e. a substantial outward curve, while retaining a reasonable degree of flexural rigidity and thereby a good edge grip, since the uplift in the lower lateral edges of the ski according to the present invention is adapted all the way to the sidecut or outward curve of the lateral surfaces. It is known in the prior art that a given sidecut or outward curve can be compensated for by, amongst other things, reducing the flexural rigidity in the direction of the ski's tip and rear edge and partly also by reducing the torsional rigidity in the same directions. In addition the present invention provides a ski in which the outward curve is compensated by a corresponding uplift in the lower lateral edge. There is agreement amongst those skilled in the art that a sidecut can offer considerable advantages and according to the present invention it is possible to make this sidecut relatively substantial, since in any case the uplift compensates for the increased sidecut without necessitating a reduction of the flexural rigidity or torsional rigidity in the direction of the ski's tip or rear end, as was previously the case. According to the present invention, therefore, the uplift employed should increase with the increase in width, i.e. with the outward curve of the lateral surfaces due to their sidecut, and in such a manner that the uplift increases with the increasing distance from C–C' towards the tip and rear edge of the ski. In the case of the ski according to the present invention, however, in sections around C–C' the sidecut and outward curve are extremely moderate, with the result that if the flat sliding surface extends all the way to the lower lateral edges in this section of the ski, and the transverse line C–C' is located in the plane of the first sliding surface 2, in practice a substantial section of the sole on both sides of C–C' will also be located in the plane of the first sliding surface 2, this sliding surface thus extending all the way to the lower lateral edge 7*a*, 7*b* on both sides, even though it may in theory be considered ideal for the uplift of the lateral edges 7*a*, 7*b* to constantly increase with the increasing width from C–C' in the direction of A–A' and E–E' respectively.

As is well known to those skilled in the art, a substantial sidecut results in an excessively strong edge grip at front and rear parts of the ski, which in turn causes the front part of ski to be inclined to carve into the snow, while at the same time vibrations occur in the ski. Previously, however, the desire for a good edge grip has caused the designers to relinquish the idea of giving the lateral edges an uplift, while at the same time choosing to refrain from making the sidecut too great. According to the present invention a ski is provided which permits an edge grip to be obtained which is neither too great nor too small, since the uplift of the lower lateral edge increases with an increasing outward curve. The result is that the ski acquires a highly favourable shape even with a substantial sidecut, while at the same time there is no necessity to reduce flexural rigidity or torsional rigidity, and hence the ski according to the present invention retains the good dynamic properties normally found in a ski with a slight sidecut.

It has been shown to be particularly advantageous for the first sliding surface 2 between A–A' and E–E' or at least from A–A' or E–E' towards C–C' to be limited by straight lines parallel to the central longitudinal axis when the ski has curved lateral surfaces 6*a*, 6*b*. The outward curve in the section between lines C–C' and E–E' combined with a flat sliding surface over the entire sole will for instance exhibit a greater gliding resistance due to the increase in width of the ski between C–C' and E–E' in this case. It is thus evident that the ski according to the present invention wherein the width of the first gliding surface 2 is independent of the sidecut, may also offer advantages when gliding or skiing approximately straight ahead.

In certain snow conditions the fact that the first, flat sliding surface 2 has some degree of limitation in relation to the sole's total surface will provide a better glide. When the lower lateral edges 7*a, b* of the ski according to the present invention are provided with an uplift, this requires the flat sliding surface to be limited. This too is a factor which offers advantages when gliding or skiing approximately straight ahead.

Known skis which have a high degree of sidecut and a substantial outward curve and a flat sliding surface can prove dangerous for a skier at high speed, especially in flat sections where it will be easy for the ski to "catch" an edge. This problem has proved to be particularly relevant after a nasty and widely reported Alpine skiing accident at Garmisch-Partenkirchen in the winter of 1994, but it can be eliminated to a considerable extent by using a ski according to the present invention whose lateral edges are provided with a harmonic uplift in relation to the outward curve. For instance in a ski with a flat sole, in transition from a left turn to a right turn (or vice versa), the grip will change almost instantaneously from the left to the right edge, but with ski according to the invention, the grip of the left edge is gradually reduced, while the right edge grip subsequently gradually increases.

EXAMPLES

The attached tables 1–6 give examples of numerical calculation of the pair of Alpine skis according to the present invention.

In the first example which is found in table 1, the ski has a length of 2050 mm and a minimum width at C–C' f 55 mm. The outward curve of the lateral edges is calculated by means of a circle and an ellipse respectively and values for the ski's width in the various cases are specified at 50 mm intervals over a distance of 150 mm from the tip to the rear edge. The uplift as a function of the increases in width is found in columns 3–5 in the table, column 3 specifying an uplift which increases linearly with the increase in width, column 4 an uplift which has a non-linear relation to the increase in width and column 5 an uplift which is in linear relation to the increase in width, but with the addition of a correction factor.

Example 2 concerns a ski with a length of 1900 mm and minimum width of 60 mm. The calculation results are presented in table 2 which is set up in the same way as table 1.

Example 3 concerns a ski with a length of 2100 mm and with a particularly substantial outward curve, especially at A–A'. The calculation results are presented in table 3 which is set up in the same way as table 1.

Example 4 concerns a ski with a length of 2090 mm and a relatively slight uplift. The calculation results are presented in table 4 which is set up in the same way as table 1. The ski according to table 4 is particularly suitable for skiing at high speed or when gliding or skiing approximately straight ahead. This is particularly the case when the value of the uplift is as specified in column 5, since in this case a slight uplift is combined with a limitation of the first sliding surface 2.

Example 5 concerns a ski with a length of 2010 mm, being rather more extreme than the one in example 4, but with a moderate uplift. The calculation results are presented in table 4 which is set up in the same way as table 1.

Finally example 6 concerns an asymmetric ski with a length of 2020 mm. The calculation results are presented in table 6, where the second and fourth columns give the half-widths of the ski on each side of the central longitudinal axis Y. The corresponding uplifts are given in columns three and five respectively. The asymmetry arises from choosing different radii of curvature for the lateral surfaces respectively.

It will be evident from the above description and the examples that within the scope of the invention it will be possible to design a large number of variant embodiments of the ski according to the invention and thus obtain a ski which is optimal in regard of different objectives and various conditions of use.

TABLE 1

Parameters for the calculation of "AN ALPINE PAIRSKI". All measurements are in millimeters

| Total width at A–A | Total width at C–C | Length C–A | Length C–E | % uplift of the side edge relative to the increase of the total width | Calculated radius for a circle with arc through C and A and with center on the X-axis |
|---|---|---|---|---|---|
| 90 | 55 | 1000 | 800 | 10,0 | 28580 |

Equation 1 Uplift (mm) = 10,0% × Increase of Width
Equation 2 Uplift (mm) = 10,0% × Increase of Width + 0,3 mm
Equation 3 $Y^2/A^2 + X^2/B^2 = 1$ (Ellipse)
where A = 2000 and B = 130,7
All three equations are valid between A–A' and E–E' only.

| Distance from the tip | Total width calculated from lower lateral edges following a circular path | Uplift of the lower lateral edges according to Equation 1 | Uplift of the lower lateral edges nonlinear to the increase in width | Uplift of the lower lateral edges according to Equation 2 | Total width calculated from lower lateral edges following an elliptic path | Trans-versal lines |
|---|---|---|---|---|---|---|
| 150 | 92,0 | 3,80 | 3,80 | 4,1 | 92,0 | F–F' |
| 200 | 90,0 | 3,50 | 3,50 | 3,8 | 90,0 | A–A' |
| 250 | 86,6 | 3,16 | 3,09 | 3,5 | 86,4 | |
| 300 | 83,3 | 2,83 | 2,70 | 3,1 | 83,0 | |
| 350 | 80,3 | 2,53 | 2,33 | 2,8 | 79,8 | |
| 400 | 77,4 | 2,24 | 1,99 | 2,5 | 76,8 | |
| 450 | 74,7 | 1,97 | 1,66 | 2,3 | 74,1 | |
| 500 | 72,1 | 1,71 | 1,36 | 2,0 | 71,5 | |
| 550 | 69,8 | 1,48 | 1,07 | 1,8 | 69,2 | |
| 600 | 67,6 | 1,26 | 0,81 | 1,6 | 67,0 | |
| 650 | 65,6 | 1,06 | 0,57 | 1,4 | 65,1 | |
| 700 | 63,7 | 0,87 | 0,35 | 1,2 | 63,3 | |
| 750 | 62,1 | 0,71 | 0,15 | 1,0 | 61,7 | |
| 800 | 60,6 | 0,56 | 0,00 | 0,9 | 60,3 | |
| 850 | 59,3 | 0,43 | 0,00 | 0,7 | 59,0 | |
| 900 | 58,1 | 0,31 | 0,00 | 0,6 | 58,0 | |
| 950 | 57,2 | 0,22 | 0,00 | 0,5 | 57,1 | |
| 1000 | 56,4 | 0,14 | 0,00 | 0,4 | 56,3 | |
| 1050 | 55,8 | 0,08 | 0,00 | 0,4 | 55,7 | |
| 1100 | 55,3 | 0,03 | 0,00 | 0,3 | 55,3 | |
| 1150 | 55,1 | 0,01 | 0,00 | 0,3 | 55,1 | |
| 1200 | 55,0 | 0,00 | 0,00 | 0,3 | 55,0 | C–C' |

TABLE 1-continued

Parameters for the calculation of "AN ALPINE PAIRSKI". All measurements are in millimeters

| | | | | | | |
|---|---|---|---|---|---|---|
| 1250 | 55,1 | 0,01 | 0,00 | 0,3 | 55,1 | |
| 1300 | 55,3 | 0,03 | 0,00 | 0,3 | 55,3 | |
| 1350 | 55,8 | 0,08 | 0,00 | 0,4 | 55,7 | |
| 1400 | 56,4 | 0,14 | 0,00 | 0,4 | 56,3 | |
| 1450 | 57,2 | 0,22 | 0,00 | 0,5 | 57,1 | |
| 1500 | 58,1 | 0,31 | 0,00 | 0,6 | 58,0 | |
| 1550 | 59,3 | 0,43 | 0,00 | 0,7 | 59,0 | |
| 1600 | 60,6 | 0,56 | 0,00 | 0,9 | 60,3 | |
| 1650 | 62,1 | 0,71 | 0,15 | 1,0 | 61,7 | |
| 1700 | 63,7 | 0,87 | 0,35 | 1,2 | 63,3 | |
| 1750 | 65,6 | 1,06 | 0,57 | 1,4 | 65,1 | |
| 1800 | 67,6 | 1,26 | 0,81 | 1,6 | 67,0 | |
| 1850 | 69,8 | 1,48 | 1,07 | 1,8 | 69,2 | |
| 1900 | 72,1 | 1,71 | 1,36 | 2,0 | 71,5 | |
| 1950 | 74,7 | 1,97 | 1,66 | 2,3 | 74,1 | |
| 2000 | 77,4 | 2,24 | 1,99 | 2,5 | 76,8 | E–E' |
| 2020 | 78,0 | 2,30 | 2,06 | 2,6 | 77,4 | G–G' |
| 2050 | 75,0 | 4,00 | 4,00 | 4,3 | 74,0 | End |

TABLE 2

Parameters for the calculation of "AN ALPINE PAIRSKI". All measurements are in millimeters

| Total width at A–A | Total width at C–C | Length C–A | Length C–E | % uplift of the side edge relative to the increase of the total width | Calculated radius for a circle with arc through C and A and with center on the X-axis |
|---|---|---|---|---|---|
| 85 | 60 | 950 | 700 | 7,2 | 36106 |

Equation 1 Uplift (mm) = 7,2% × Increase of Width
Equation 2 Uplift (mm) = 7,2% × Increase of Width + 0,3 mm
Equation 3 $Y^2/A^2 + X^2/B^2 = 1$ (Ellipse)
where A = 1800 and B = 83
All three equations are valid between A–A' and E–E' only.

| Distance from the tip | Total width calculated from lower lateral edges following a circular path | Uplift of the lower lateral edges according to Equation 1 | Uplift of the lower lateral edges nonlinear to the increase in width | Uplift of the lower lateral edges according to Equation 2 | Total width calculated from lower lateral edges following an elliptic path | Trans-versal lines |
|---|---|---|---|---|---|---|
| 160 | 86,0 | 1,90 | 1,90 | 2,2 | 92,0 | F–F' |
| 200 | 85,0 | 1,80 | 1,80 | 2,1 | 85,0 | A–A' |
| 250 | 82,4 | 1,62 | 1,56 | 1,9 | 82,2 | |
| 300 | 80,0 | 1,44 | 1,33 | 1,7 | 79,7 | |
| 350 | 77,7 | 1,28 | 1,12 | 1,6 | 77,3 | |
| 400 | 75,6 | 1,12 | 0,92 | 1,4 | 75,1 | |
| 450 | 73,6 | 0,98 | 0,73 | 1,3 | 73,1 | |
| 500 | 71,7 | 0,84 | 0,56 | 1,1 | 71,2 | |
| 550 | 70,0 | 0,72 | 0,39 | 1,0 | 69,5 | |
| 600 | 68,4 | 0,60 | 0,24 | 0,9 | 67,9 | |
| 650 | 66,9 | 0,50 | 0,11 | 0,8 | 66,5 | |
| 700 | 65,6 | 0,40 | 0,00 | 0,7 | 65,3 | |
| 750 | 64,4 | 0,32 | 0,00 | 0,6 | 64,2 | |
| 800 | 63,4 | 0,24 | 0,00 | 0,5 | 63,2 | |
| 850 | 62,5 | 0,18 | 0,00 | 0,5 | 62,3 | |
| 900 | 61,7 | 0,12 | 0,00 | 0,4 | 61,6 | |
| 950 | 61,1 | 0,08 | 0,00 | 0,4 | 61,0 | |
| 1000 | 60,6 | 0,04 | 0,00 | 0,3 | 60,6 | |
| 1050 | 60,3 | 0,02 | 0,00 | 0,3 | 60,3 | |
| 1100 | 60,1 | 0,00 | 0,00 | 0,3 | 60,1 | |
| 1150 | 60,0 | 0,00 | 0,00 | 0,3 | 60,0 | C–C' |
| 1200 | 60,1 | 0,00 | 0,00 | 0,3 | 60,1 | |
| 1250 | 60,3 | 0,02 | 0,00 | 0,3 | 60,3 | |
| 1300 | 60,6 | 0,04 | 0,00 | 0,3 | 60,6 | |
| 1350 | 61,1 | 0,08 | 0,00 | 0,4 | 61,0 | |
| 1400 | 61,7 | 0,08 | 0,00 | 0,4 | 61,6 | |
| 1450 | 62,5 | 0,18 | 0,00 | 0,5 | 62,3 | |
| 1500 | 63,4 | 0,24 | 0,00 | 0,5 | 63,2 | |
| 1550 | 64,4 | 0,32 | 0,00 | 0,6 | 64,2 | |
| 1600 | 65,6 | 0,40 | 0,00 | 0,7 | 65,3 | |
| 1650 | 66,9 | 0,50 | 0,11 | 0,8 | 66,5 | |

TABLE 2-continued

| Parameters for the calculation of "AN ALPINE PAIRSKI". All measurements are in millimeters | | | | | | |
|---|---|---|---|---|---|---|
| 1700 | 68,4 | 0,60 | 0,24 | 0,9 | 67,9 | |
| 1750 | 70,0 | 0,72 | 0,39 | 1,0 | 69,5 | |
| 1800 | 71,7 | 0,84 | 0,56 | 1,1 | 71,2 | |
| 1850 | 73,6 | 0,98 | 0,73 | 1,3 | 73,1 | E–E' |
| 1887 | 74,0 | 1,01 | 0,77 | 1,3 | 73,5 | G–G' |
| 1900 | 71,0 | 3,00 | 3,00 | 3,3 | 70,5 | End |

TABLE 3

Parameters for the calculation of "AN ALPINE PAIRSKI". All measurements are in millimeters

| Total width at A–A | Total width at C–C | Length C–A | Length C–E | % uplift of the side edge relative to the increase of the total width | Calculated radius for a circle with arc through C and A and with center on the X-axis |
|---|---|---|---|---|---|
| 120 | 60 | 1100 | 850 | 8,4 | 20182 |

Equation 1 Uplift (mm) = 8,4% × Increase of Width
Equation 2 Uplift (mm) = 8,4% × Increase of Width + 0,3 mm
Equation 3 $Y^2/A^2 + X^2/B^2 = 1$ (Ellipse)
where A = 1900 and B = 162,5
All three equations are valid between A–A' and E–E' only.

| Distance from the tip | Total width calculated from lower lateral edges following a circular path | Uplift of the lower lateral edges according to Equation 1 | Uplift of the lower lateral edges nonlinear to the increase in width | Uplift of the lower lateral edges according to Equation 2 | Total width calculated from lower lateral edges following an elliptic path | Trans-versal lines |
|---|---|---|---|---|---|---|
| 170 | 121,5 | 5,30 | 5,30 | 5,6 | 121,5 | F–F' |
| 200 | 120,0 | 5,04 | 5,04 | 5,3 | 120,0 | A–A' |
| 250 | 114,7 | 4,59 | 4,50 | 4,9 | 114,1 | |
| 300 | 109,6 | 4,16 | 3,99 | 4,5 | 108,7 | |
| 350 | 104,7 | 3,76 | 3,50 | 4,1 | 103,5 | |
| 400 | 100,2 | 3,37 | 3,04 | 3,7 | 98,8 | |
| 450 | 95,8 | 3,01 | 2,60 | 3,3 | 94,3 | |
| 500 | 91,7 | 2,66 | 2,19 | 3,0 | 90,2 | |
| 550 | 87,9 | 2,34 | 1,80 | 2,6 | 86,4 | |
| 600 | 84,3 | 2,04 | 1,44 | 2,3 | 82,9 | |
| 650 | 80,9 | 1,76 | 1,10 | 2,1 | 79,6 | |
| 700 | 77,8 | 1,50 | 0,79 | 1,8 | 76,6 | |
| 750 | 75,0 | 1,26 | 0,50 | 1,6 | 73,9 | |
| 800 | 72,4 | 1,04 | 0,24 | 1,3 | 71,5 | |
| 850 | 70,0 | 0,84 | 0,00 | 1,1 | 69,2 | |
| 900 | 67,9 | 0,67 | 0,00 | 1,0 | 67,3 | |
| 950 | 66,1 | 0,51 | 0,00 | 0,8 | 65,6 | |
| 1000 | 64,5 | 0,37 | 0,00 | 0,7 | 64,1 | |
| 1050 | 63,1 | 0,26 | 0,00 | 0,6 | 62,8 | |
| 1100 | 62,0 | 0,17 | 0,00 | 0,5 | 61,8 | |
| 1150 | 61,1 | 0,09 | 0,00 | 0,4 | 61,0 | |
| 1200 | 60,5 | 0,04 | 0,00 | 0,3 | 60,5 | |
| 1250 | 60,1 | 0,01 | 0,00 | 0,3 | 60,1 | |
| 1300 | 60,0 | 0,00 | 0,00 | 0,3 | 60,0 | C–C' |
| 1350 | 60,1 | 0,01 | 0,00 | 0,3 | 60,1 | |
| 1400 | 60,5 | 0,04 | 0,00 | 0,3 | 60,5 | |
| 1450 | 61,1 | 0,09 | 0,00 | 0,4 | 61,0 | |
| 1500 | 62,0 | 0,17 | 0,00 | 0,5 | 61,8 | |
| 1550 | 63,1 | 0,26 | 0,00 | 0,6 | 62,8 | |
| 1600 | 64,5 | 0,37 | 0,00 | 0,7 | 64,1 | |
| 1650 | 66,1 | 0,51 | 0,00 | 0,8 | 65,6 | |
| 1700 | 67,9 | 0,67 | 0,00 | 1,0 | 67,3 | |
| 1750 | 70,0 | 0,84 | 0,00 | 1,1 | 69,2 | |
| 1800 | 72,4 | 1,04 | 0,24 | 1,3 | 71,5 | |
| 1850 | 75,0 | 1,26 | 0,50 | 1,6 | 73,9 | |
| 1900 | 77,8 | 1,50 | 0,79 | 1,8 | 76,6 | |
| 1950 | 80,9 | 1,76 | 1,10 | 2,1 | 79,6 | |
| 2000 | 84,3 | 2,04 | 1,44 | 2,3 | 82,9 | |
| 2050 | 87,9 | 2,34 | 1,80 | 2,6 | 86,4 | |
| 2100 | 91,7 | 2,66 | 2,19 | 3,0 | 90,2 | |
| 2150 | 95,8 | 3,01 | 2,60 | 3,3 | 94,3 | E–E' |
| 2170 | 96,8 | 3,09 | 2,70 | 3,4 | 95,3 | G–G' |
| 2200 | 88,0 | 5,00 | 5,00 | 5,0 | 86,5 | End |

TABLE 4

Parameters for the calculation of "AN ALPINE PAIRSKI". All measurements are in millimeters

| Total width at A–A | Total width at C–C | Length C–A | Length C–E | % uplift of the side edge relative to the increase of the total width | Calculated radius for a circle with arc through C and A and with center on the X-axis |
|---|---|---|---|---|---|
| 85 | 65 | 1050 | 800 | 5,0 | 55130 |

Equation 1 Uplift (mm) = 5,0% × Increase of Width
Equation 2 Uplift (mm) = 5,0% × Increase of Width + 0,3 mm
Equation 3 $Y^2/A^2 + X^2/B^2 = 1$ (Ellipse)
where A = 2100 and B = 74,5
All three equations are valid between A–A' and E–E' only.

| Distance from the tip | Total width calculated from lower lateral edges following a circular path | Uplift of the lower lateral edges according to Equation 1 | Uplift of the lower lateral edges nonlinear to the increase in width | Uplift of the lower lateral edges according to Equation 2 | Total width calculated from lower lateral edges following an elliptic path | Trans-versal lines |
|---|---|---|---|---|---|---|
| 180 | 85,5 | 1,10 | 1,10 | 1,4 | 85,5 | F–F' |
| 200 | 85,0 | 1,00 | 1,00 | 1,3 | 85,0 | A–A' |
| 250 | 83,1 | 0,91 | 0,88 | 1,2 | 83,0 | |
| 300 | 81,4 | 0,82 | 0,76 | 1,1 | 81,1 | |
| 350 | 79,7 | 0,73 | 0,66 | 1,0 | 79,4 | |
| 400 | 78,1 | 0,66 | 0,55 | 1,0 | 77,8 | |
| 450 | 76,6 | 0,58 | 0,45 | 0,9 | 76,2 | |
| 500 | 75,2 | 0,51 | 0,36 | 0,8 | 74,8 | |
| 550 | 73,9 | 0,44 | 0,28 | 0,7 | 73,5 | |
| 600 | 72,7 | 0,38 | 0,20 | 0,7 | 72,3 | |
| 650 | 71,5 | 0,33 | 0,12 | 0,6 | 71,2 | |
| 700 | 70,5 | 0,27 | 0,06 | 0,6 | 70,2 | |
| 750 | 69,5 | 0,23 | 0,00 | 0,5 | 69,3 | |
| 800 | 68,7 | 0,18 | 0,00 | 0,5 | 69,3 | |
| 850 | 67,9 | 0,15 | 0,00 | 0,4 | 67,7 | |
| 900 | 67,2 | 0,11 | 0,00 | 0,4 | 67,1 | |
| 950 | 66,6 | 0,08 | 0,00 | 0,4 | 66,5 | |
| 1000 | 66,1 | 0,06 | 0,00 | 0,4 | 66,1 | |
| 1050 | 65,7 | 0,04 | 0,00 | 0,3 | 65,7 | |
| 1100 | 65,4 | 0,02 | 0,00 | 0,3 | 65,4 | |
| 1150 | 65,2 | 0,01 | 0,00 | 0,3 | 65,2 | |
| 1200 | 65,0 | 0,00 | 0,00 | 0,3 | 65,0 | |
| 1250 | 65,0 | 0,00 | 0,00 | 0,3 | 65,0 | C–C' |
| 1300 | 65,0 | 0,00 | 0,00 | 0,3 | 65,0 | |
| 1350 | 65,2 | 0,01 | 0,00 | 0,3 | 65,2 | |
| 1400 | 65,4 | 0,02 | 0,00 | 0,3 | 65,4 | |
| 1450 | 65,7 | 0,04 | 0,00 | 0,3 | 65,7 | |
| 1500 | 66,1 | 0,06 | 0,00 | 0,4 | 66,1 | |
| 1550 | 66,6 | 0,08 | 0,00 | 0,4 | 66,5 | |
| 1600 | 67,2 | 0,11 | 0,00 | 0,4 | 67,1 | |
| 1650 | 67,9 | 0,15 | 0,00 | 0,4 | 67,7 | |
| 1700 | 68,7 | 0,18 | 0,00 | 0,5 | 68,5 | |
| 1750 | 69,5 | 0,23 | 0,00 | 0,5 | 69,3 | |
| 1800 | 70,5 | 0,27 | 0,06 | 0,6 | 70,2 | |
| 1850 | 71,5 | 0,33 | 0,12 | 0,6 | 71,2 | |
| 1900 | 72,7 | 0,38 | 0,20 | 0,7 | 72,3 | |
| 1950 | 73,9 | 0,44 | 0,28 | 0,7 | 72,3 | |
| 2000 | 75,2 | 0,51 | 0,36 | 0,8 | 74,8 | |
| 2050 | 76,6 | 0,58 | 0,45 | 0,9 | 76,2 | E–E' |
| 2060 | 76,8 | 0,59 | 0,47 | 0,9 | 76,4 | G–G' |
| 2090 | 74,0 | 3,00 | 3,00 | 3,0 | 74,0 | End |

TABLE 5

Parameters for the calculation of "AN ALPINE PAIRSKI". All measurements are in millimeters

| Total width at A–A | Total width at C–C | Length C–A | Length C–E | % uplift of the side edge relative to the increase of the total width | Calculated radius for a circle with arc through C and A and with center on the X-axis |
|---|---|---|---|---|---|
| 110 | 62 | 950 | 800 | 5,0 | 18814 |

Equation 1 Uplift (mm) = 5,0% × Increase of Width
Equation 2 Uplift (mm) = 5,0% × Increase of Width + 0,3 mm
Equation 3 $Y^2/A^2 + X^2/B^2 = 1$ (Ellipse)
where A = 1600 and B = 122,8
All three equations are valid between A–A' and E–E' only.

| Distance from the tip | Total width calculated from lower lateral edges following a circular path | Uplift of the lower lateral edges according to Equation 1 | Uplift of the lower lateral edges nonlinear to the increase in width | Uplift of the lower lateral edges according to Equation 2 | Total width calculated from lower lateral edges following an elliptic path | Trans-versal lines |
|---|---|---|---|---|---|---|
| 160 | 112,0 | 2,60 | 2,55 | 2,9 | 112,0 | F–F' |
| 200 | 110,0 | 2,40 | 2,34 | 2,7 | 110,0 | A–A' |
| 250 | 105,1 | 2,15 | 2,02 | 2,5 | 104,5 | |
| 300 | 100,4 | 1,92 | 1,72 | 2,2 | 99,5 | |
| 350 | 96,0 | 1,70 | 1,43 | 2,0 | 94,9 | |
| 400 | 91,9 | 1,50 | 1,16 | 1,8 | 90,7 | |
| 450 | 88,1 | 1,30 | 0,91 | 1,6 | 86,8 | |
| 500 | 84,5 | 1,12 | 0,68 | 1,4 | 83,2 | |
| 550 | 81,1 | 0,96 | 0,46 | 1,3 | 79,9 | |
| 600 | 78,1 | 0,80 | 0,27 | 1,1 | 77,0 | |
| 650 | 75,3 | 0,66 | 0,08 | 1,0 | 74,3 | |
| 700 | 72,8 | 0,54 | 0,00 | 0,8 | 71,9 | |
| 750 | 70,5 | 0,43 | 0,00 | 0,7 | 69,8 | |
| 800 | 68,5 | 0,33 | 0,00 | 0,6 | 67,9 | |
| 850 | 66,8 | 0,24 | 0,00 | 0,5 | 66,4 | |
| 900 | 65,3 | 0,17 | 0,00 | 0,5 | 65,0 | |
| 950 | 64,1 | 0,11 | 0,00 | 0,4 | 63,9 | |
| 1000 | 63,2 | 0,06 | 0,00 | 0,4 | 63,1 | |
| 1050 | 62,5 | 0,03 | 0,00 | 0,3 | 62,5 | |
| 1100 | 62,1 | 0,01 | 0,00 | 0,3 | 62,1 | |
| 1150 | 62,0 | 0,00 | 0,00 | 0,3 | 62,0 | C–C' |
| 1200 | 62,1 | 0,01 | 0,00 | 0,3 | 62,1 | |
| 1250 | 62,5 | 0,03 | 0,00 | 0,3 | 62,5 | |
| 1300 | 63,2 | 0,06 | 0,00 | 0,4 | 63,1 | |
| 1350 | 64,1 | 0,11 | 0,00 | 0,4 | 63,9 | |
| 1400 | 65,3 | 0,17 | 0,00 | 0,5 | 65,0 | |
| 1450 | 66,8 | 0,24 | 0,00 | 0,5 | 66,4 | |
| 1500 | 68,5 | 0,33 | 0,00 | 0,6 | 67,9 | |
| 1550 | 70,5 | 0,43 | 0,00 | 0,7 | 69,8 | |
| 1600 | 72,8 | 0,54 | 0,00 | 0,8 | 71,9 | |
| 1650 | 75,3 | 0,66 | 0,08 | 1,0 | 74,3 | |
| 1700 | 78,1 | 0,80 | 0,27 | 1,1 | 77,0 | |
| 1750 | 81,1 | 0,96 | 0,46 | 1,3 | 79,9 | |
| 1800 | 84,5 | 1,12 | 0,68 | 1,4 | 83,2 | |
| 1850 | 88,1 | 1,30 | 0,91 | 1,6 | 86,8 | |
| 1900 | 91,9 | 1,50 | 1,16 | 1,8 | 90,7 | |
| 1950 | 96,0 | 1,70 | 1,43 | 2,0 | 94,9 | E–E' |
| 1970 | 97,0 | 1,75 | 1,50 | 2,1 | 96,0 | G–G' |
| 2010 | 90,9 | 4,00 | 3,80 | 4,3 | 89,0 | End |

TABLE 6

Parameters for the calculation of "AN ALPINE PAIRSKI", assymetric version. All measurements are in millimeters Left side of the Left ski = Right side of the Right ski
Right side of the Left ski = Left side of the Right ski
Starting from the central longitudinal axis Y

| | | | |
|---|---|---|---|
| Halfwidth: A(LL)-S = A'(RR)-S = | 50 | Corresponding radius | 23760 |
| Halfwidth: A(RL)-S = A'(LR)-S = | 52 | Corresponding radius | 21499 |
| Halfwidth C-S(both sides are chosen equal) = | 31 | | |
| | Length A–C = | Length A'–C' = | 950 |
| | Length C–E = | Length C'–E' = | 800 |
| Uplift (one side) = N % × Width increase at the same side | | N = | 12 |

| Distance from the tip | Halfwidth for the Left side of the Left ski and the Right side of the Right ski | Uplift in the lower lateral edge of the Left side of the Left ski and the Right side of the Right ski | Halfwidth for the Right side of the Left ski and the Left side of the Right ski | Uplift in the lower lateral edge of the Right side of the Left ski and the Left side of the Right ski | Transversal Total width | lines |
|---|---|---|---|---|---|---|
| 170 | 50,7 | 2,5 | 52,8 | 2,7 | 103,5 | F–F' |
| 200 | 50,0 | 2,3 | 52,0 | 2,5 | 102,0 | A–A' |
| 250 | 48,1 | 2,0 | 49,8 | 2,3 | 97,0 | |
| 300 | 46,2 | 1,8 | 47,8 | 2,0 | 94,0 | |
| 350 | 44,5 | 1,6 | 45,9 | 1,8 | 90,4 | |
| 400 | 42,8 | 1,4 | 44,1 | 1,6 | 86,9 | |
| 450 | 41,3 | 1,2 | 42,4 | 1,4 | 83,7 | |
| 500 | 39,9 | 1,1 | 40,8 | 1,2 | 80,7 | |
| 550 | 38,6 | 0,9 | 39,4 | 1,0 | 78,0 | |
| 600 | 37,4 | 0,8 | 38,0 | 0,8 | 75,4 | |
| 650 | 36,3 | 0,6 | 36,8 | 0,7 | 73,1 | |
| 700 | 35,3 | 0,5 | 35,7 | 0,6 | 71,0 | |
| 750 | 34,4 | 0,4 | 34,7 | 0,4 | 69,1 | |
| 800 | 33,6 | 0,3 | 33,8 | 0,3 | 67,4 | |
| 850 | 32,9 | 0,2 | 33,1 | 0,3 | 66,0 | |
| 900 | 32,3 | 0,2 | 32,5 | 0,2 | 64,8 | |
| 950 | 31,8 | 0,1 | 31,9 | 0,1 | 63,8 | |
| 1000 | 31,5 | 0,1 | 31,5 | 0,1 | 63,0 | |
| 1050 | 31,2 | 0,0 | 31,2 | 0,0 | 62,4 | |
| 1100 | 31,1 | 0,0 | 31,1 | 0,0 | 62,1 | |
| 1150 | 31,0 | 0,0 | 31,0 | 0,0 | 62,0 | C–C' |
| 1200 | 31,1 | 0,0 | 31,1 | 0,0 | 62,1 | |
| 1250 | 31,2 | 0,0 | 31,2 | 0,0 | 62,4 | |
| 1300 | 31,5 | 0,1 | 31,5 | 0,1 | 63,0 | |
| 1350 | 31,8 | 0,1 | 31,9 | 0,1 | 63,8 | |
| 1400 | 32,3 | 0,2 | 32,5 | 0,2 | 64,8 | |
| 1450 | 32,9 | 0,2 | 33,1 | 0,3 | 66,0 | |
| 1500 | 33,6 | 0,3 | 33,8 | 0,3 | 67,4 | |
| 1550 | 34,4 | 0,4 | 34,7 | 0,4 | 69,1 | |
| 1600 | 35,3 | 0,5 | 35,7 | 0,6 | 71,0 | |
| 1650 | 36,3 | 0,6 | 36,8 | 0,7 | 73,1 | |
| 1700 | 37,4 | 0,8 | 38,0 | 0,8 | 75,4 | |
| 1750 | 38,6 | 0,9 | 39,4 | 1,0 | 78,0 | |
| 1800 | 39,9 | 1,1 | 40,8 | 1,2 | 80,7 | |
| 1850 | 41,3 | 1,2 | 42,4 | 1,4 | 83,7 | |
| 1900 | 42,8 | 1,4 | 44,1 | 1,6 | 86,9 | |
| 1950 | 44,5 | 1,6 | 45,9 | 1,8 | 90,4 | E–E' |
| 1980 | 45,0 | 1,7 | 46,5 | 1,9 | 91,5 | G–G' |
| 2020 | 42,0 | 4,0 | 43,5 | 4,0 | 85,5 | End |

I claim:

1. An Alpine ski (1) with a front section (3) including an upturned tip **(3*a*), a rear section (5) including an end portion (5*a*), and a main section with a sole which comprises, with reference to a plane of the sole with a camber of the ski reduced to zero, a flat first sliding surface (2) which extends on both sides of a central longitudinal axis Y of the ski at least to the front and rear sections (3, 5) respectively, and where lateral surfaces (6*a, b*) of the ski are provided with an approximately continuous concave sidecut between a first transition line A–A' defining a transition from the main section to the front section (3) and a second transition line E–E' defining a transition from the main section to the rear section (5) of the ski, and wherein lower lateral edges (7*a, b*) between the transition lines A–A' and E–E' approximate continuous curves with a radius of curvature in any arbitrary point between the first and second transition lines of at most 80 m, wherein the sole on both sides of the first sliding surface (2) comprises additional sliding surfaces (4) which extend upwards from an edge of the first sliding surface (2) to the lower lateral edges (7*a, b*) of the ski with an uplift ($H_s$) whose value at a point on one of the lower lateral edges (7*a, b*) of the ski is given by a length of a perpendicular from this point to said plane of the sole, the additional sliding surfaces (4) extending in a longitudinal direction of the ski at least from the first and second transition lines A–A' and E–E', respectively, towards a transversal line C–C', substantially perpendicular to the central longitudinal axis Y behind the middle of the ski and in a section of the ski where a binding is attached, a width of the ski at the line C–C' being equal to a smallest width of the ski between lines A–A' and E–E', the additional sliding surfaces (4) extending on each side over a length which is at least 20% of a length of the main section between the lines A–A' and E–E', such that the length of the additional sliding surfaces (4) in the main section from line A–A' toward line C–C' is at least 20 cm, and that the uplift ($H_s$) in the lower lateral edges (7***a, b*) on the additional sliding surfaces (4) substantially increases with an increasing width of the ski in a direction of the lines A–A' and E–E' respectively, whereby the uplift ($H_s$) at A–A' is at least 1/2000 of a length of the first sliding surface (2) between the lines A–A' and E–E'.

2. An Alpine ski according to claim 1, wherein the additional sliding surfaces (4) and optionally the first sliding surface (2) are extended beyond the first transition line A–A' into the front section (3) and terminate at a transversal line F–F' substantially perpendicular to the central longitudinal axis Y, the line F–F' defining a transition from the first and additional sliding surfaces (2, 4) in the front section (3) to the upturned tip (3*a*), the lower lateral edges (7*a,b*) each having a turning point at the line A–A', providing a continuous transition from a concave sidecut in the main section to a convex sidecut in the front section (3), and wherein the uplift of the lower lateral edges (7*a,b*) of the ski in the front section (3) between the transition lines A–A' and F–F' at any point is at least as large as the uplift at the transition line A–A'.

3. An Alpine ski according to claim 1, wherein the additional sliding surfaces (4) and optionally the first sliding surface (2) are extended beyond the second transition line E–E' into the rear section (5) and terminate at a transversal line G–G' substantially perpendicular to the central longitudinal axis Y, the line G–G' defining a transition from the first and additional sliding surfaces (2; 4) in the rear section (5) to the end portion (5*a*), the lower lateral edges (7*a,b*) each having a turning point at the line E–E', providing a continuous transition from a concave sidecut in the main section to a convex sidecut in the rear section (5), and wherein the uplift of the lower lateral edges (7*a,b*) of the ski in the rear section (5) between the lines E–E' and G–G' at any point is at least as large as the uplift at the transition line E–E'.

4. An Alpine ski according to claim 1, wherein the ski is symmetrical about the central longitudinal axis Y, the lines of transition A–A', E–E', F–F', G–G' as well as the transversal line C–C' all being perpendicular to the axis Y.

5. An Alpine ski according to claim 4, wherein the sidecut of the lower lateral edges (7*a, b*) between the transition lines A–A', E–E' is approximately equivalent to a curvature of congruent arcs in circles where a section of the circumference defines the lower lateral edges between the transition lines A–A', E–E', and the transversal line C–C' constitutes an extension of a radius in each of the circles, the radii of the circles within arbitrarily selected sections 20 cm in length between lines A–A' and E–E' not deviating by more than ±20% from a radius of an imaginary circle which passes through the starting and end points together with the middle of the arbitrarily selected section between A–A' and E–E'.

6. An Alpine ski according to claim 4, wherein the sidecut of the lower lateral edges (7*a, b*) between the transition lines A–A', E–E' is approximately equivalent to a curvature of congruent arcs of ellipses where a section of the circumference defines the lower lateral edges (7*a, b*) between the transition lines A–A', E–E', and the transversal line C–C' constitutes an extension of the ellipses' minor axis, the radii of curvature of the ellipses within arbitrarily selected sections 20 cm in length between lines A–A' and E–E' not deviating by more than ±20% from a radius of an imaginary circle which passes through the starting and end points together with the middle of the arbitrarily selected section between A–A' and E–E'.

7. An Alpine ski according to claim 1, wherein the uplift ($H_s$) at the transition line A–A' constitutes at least 1/1000 of a length of the first sliding surface (2).

8. An Alpine ski according to claim 1, wherein the lower lateral edges (7*a, b*) at an arbitrary point between the transition lines A–A' and E–E' have a radius of curvature of maximum 40 meters.

9. An Alpine ski according to claim 1, wherein the uplift ($H_s$) as defined at an arbitrary point on the lower lateral edges is given as an approximately linear function of the increase in the width of the ski between the transversal line C–C' and the perpendicular on the central longitudinal axis at this point, the uplift ($H_s$) being obtained from the following formula:

$$H_s = K_1 + K_2 \cdot \Delta X + M(y)$$

where $H_s$ is the uplift in millimetres, $K_1$ and $K_2$ are suitable selected constants, $\Delta X$ is the increase in width and M(y) is a function of the distance (the length of the ski) between line C–C' and said perpendicular, so that the functional value $|M(y)|<1$ mm.

10. An Alpine ski according to claim 1, wherein a width of the first sliding surface (2) at the transverse line C–C' is equal to the width of the ski at C–C' and wherein the uplift of the lower lateral edges (7*a*, 7*b*) at C–C' is zero.

11. An Alpine ski according to claim 1, wherein the first sliding surface (2) extends to the lower lateral edges (7*a, b*) of the ski in a section of the sole on both sides of the transversal line C–C' and between a second transversal line B–B' in a section of the sole from line C–C' to line A–A' and a third transversal line D–D' in a section from line C–C' to line E–E', the uplift ($H_s$) of the lateral edges (7*a, b*) between lines B–B', D–D' being zero.

12. An Alpine ski according to claim 1, where the first sliding surface (2) extends substantially symmetrically about the ski's central longitudinal axis and wherein a width of the first sliding surface (2) is less than the width of the ski, the additional sliding surfaces (4) on both sides of the first sliding surface extending along the entire sole between the transition lines A–A', E–E', the uplift ($H_s$) of the lower lateral edges (7*a, b*) at the transversal line C–C' being at most 2 mm.

* * * * *